US010275976B2

(12) United States Patent
Koenigsknecht et al.

(10) Patent No.: US 10,275,976 B2
(45) Date of Patent: Apr. 30, 2019

(54) OPTIMIZATION SYSTEM

(71) Applicants: Tony Lee Koenigsknecht, Chicago, IL (US); Albert John Kohn, Bridgman, MI (US); Scott Alan Albright, Buchanan, MI (US); Robert Kevin Blake, Three Oaks, MI (US); Jonathan Charles Shoemaker, Coloma, MI (US)

(72) Inventors: Tony Lee Koenigsknecht, Chicago, IL (US); Albert John Kohn, Bridgman, MI (US); Scott Alan Albright, Buchanan, MI (US); Robert Kevin Blake, Three Oaks, MI (US); Jonathan Charles Shoemaker, Coloma, MI (US)

(73) Assignee: Freeosk, Inc., Chicago, IL (US)

( * ) Notice: Subject to any disclaimer, the term of this patent is extended or adjusted under 35 U.S.C. 154(b) by 240 days.

(21) Appl. No.: 13/940,045

(22) Filed: Jul. 11, 2013

(65) Prior Publication Data

US 2013/0331980 A1 Dec. 12, 2013

Related U.S. Application Data

(63) Continuation-in-part of application No. 13/100,595, filed on May 4, 2011.

(60) Provisional application No. 61/331,183, filed on May 4, 2010.

(51) Int. Cl.
*G07F 11/00* (2006.01)
*G07F 11/44* (2006.01)

(52) U.S. Cl.
CPC ..... *G07F 11/005* (2013.01); *G07F 11/44* (2013.01)

(58) Field of Classification Search
CPC ..... G07F 11/005; G07F 11/44
USPC ..... 700/231–244
See application file for complete search history.

(56) References Cited

U.S. PATENT DOCUMENTS 5,671,262 A * 9/1997 Boyer ..... G06M 1/101 377/11
5,884,806 A * 3/1999 Boyer ..... A61J 7/02 221/13
5,996,316 A * 12/1999 Kirschner ..... B65G 1/1378 53/155
7,108,155 B2 * 9/2006 Kelbert ..... B65B 5/08 198/396
2005/0263537 A1 * 12/2005 Gerold ..... G07F 17/0092 221/124
2011/0047042 A1 * 2/2011 Blickhan ..... G06Q 10/06 705/26.25
2012/0104034 A1 * 5/2012 Koenigsknecht ..... G07F 13/025 221/277
2013/0331979 A1 * 12/2013 Koenigsknecht ..... B65G 33/04 700/225
2013/0331980 A1 * 12/2013 Koenigsknecht ..... G07F 11/005 700/232

(Continued)

*Primary Examiner* — Michael Collins
(74) *Attorney, Agent, or Firm* — Seyfarth Shaw LLP

(57) ABSTRACT

Methods, systems, and devices are disclosed for optimizing the delivery of products through an automated product dispensation system. The disclosed systems implement different dispensation parameters based on the size, shape, and other criteria for the different products that are dispensed through the device. The disclosed methods first identify the product being dispensed, and then determine the parameters at which the product should be dispensed for maximum efficiency.

11 Claims, 13 Drawing Sheets

(56) References Cited

U.S. PATENT DOCUMENTS

2014/0261881 A1* 9/2014 Chudy ..... A61J 7/0084
141/94

* cited by examiner

OPTIMIZATION SYSTEM

RELATED APPLICATIONS

This application is a continuation-in-part of U.S. patent application Ser. No. 13/100,595, filed May 4, 2011, which claims priority to provisional Patent Application Ser. No. 61/331,183, filed May 4, 2010, the contents of which are herein incorporated by reference in their entirety.

TECHNICAL FIELD OF THE INVENTION

The present invention relates generally to optimization methods, and more particularly, to a method of optimizing the efficiency of a product dispensation system or device.

BACKGROUND OF THE INVENTION

A popular marketing technique is to provide free product samples to potential customers to entice the customers to buy the product. The free sample can be provided to the customer by an employee of, for example, a grocery store during regular working hours while the customer is otherwise shopping for other products. The store employee can then sell the customer the product by pointing the customer to the area of the store where that product is sold, typically close to where the free sample is provided. This marketing tool is especially popular for products that have only recently entered the market or where potential customers are not likely to have sampled the product through conventional means.

Free samples can also be dispensed through automated means, as described in U.S. patent application Ser. No. 13/100,595. For example, a product dispensation device can dispense a free sample when a user scans a barcode, instructs the dispensation device through a smart phone application, or through any other manner of identification.

Automated product dispensation devices strive to deliver one product at a time. To accomplish this, the dispensation devices operate at parameters thought to achieve maximum efficiency. For example, the device may include rotating augers that rotate at a specific speed that delivers certain products in a seriatim fashion. However, these parameters are typically normalized for all products and do not take into account the different geometry or weight of the products being dispensed. Therefore, a smaller product and a larger product would currently be subject to the same operation parameters. This can cause problems during the dispensing of the products. For example, since the larger product should have a slower auger speed compared to the slower product, by using the same parameters as used with the smaller product, multiple larger products may be dispensed at one time, instead of just one of the larger products. Therefore, there exists a need to optimize different parameters of a product dispending device to ensure optimized output is achieved for different type of products.

SUMMARY OF THE INVENTION

The present application discloses a method, system, and device for optimizing the delivery of products from an automated product dispensation system. The inventors of the present application discovered that different sized products are subject to different parameters at which their delivery is most efficient and optimized. For example, larger objects may require a steeper angle of inclination or different rotational speed for auger-driven delivery. The present application overcomes this problem by first identifying the product being dispensed, and subsequently determining the parameters at which the product should be dispensed.

In particular, the present application discloses a product dispensation device adapted to hold a plurality of objects and singularly dispense the objects, including a frame, an auger having first and second open ends and being coupled to the frame and rotatable thereon, the first open end adapted to receive the objects and the second open adapted to singularly dispense the objects, a computer-readable recording medium adapted to store a computer program executable by a processor and including: instructions to receive an identification of the objects, instructions to determine a dispensation parameter whereby application of the dispensation parameter to the device is more likely to singularly dispense the objects, instructions to apply the dispensation parameter to a component adapted to control the device, and instructions to cause singular delivery of the objects when the dispensation parameter is applied.

Further disclosed is a method of optimizing the dispensing products from a product dispensing device adapted to hold a plurality of the products and singularly dispense the products, the method including identifying the products, selecting a product dispensation parameter adapted to optimize the likelihood that the products are dispensed singularly based on an identification of the products, and applying the dispensation parameter to the device.

The present application also discloses a method of optimizing singular dispensation of products from a product dispensing device having an auger and being adapted to hold a plurality of the products and singularly dispense the products by the auger, the method including identifying the products with a product identification specific to the products by at least one of a user inputting into a user interface the product identification, scanning a card having the product identification, scanning the product identification on at least one of the products, and transmitting a signal having the product identification with a portable electronic device, automatically selecting a product dispensation parameter adapted to optimize the likelihood that the product dispensing device dispenses the products singularly when requested by a user based on the product identification, wherein the product dispensation parameter includes at least one of an angle of the auger relative to a frame of the device, a rotational speed of the auger, and a rotational amount of the auger, and applying the dispensation parameter to the device.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
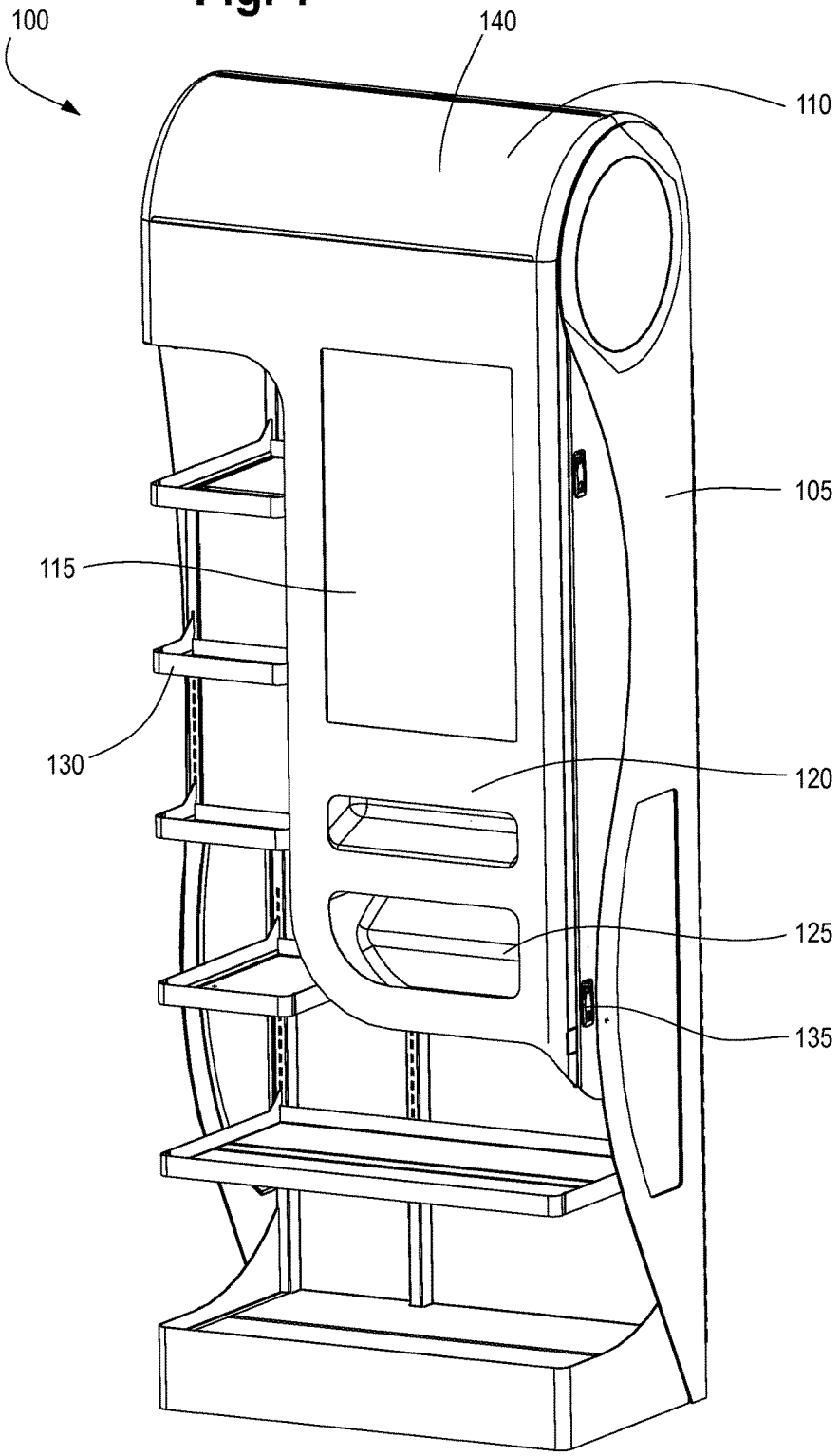
FIG. 1 illustrates an embodiment of a product dispensing device.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated.

The present application discloses a method, system, and device for optimizing the delivery of products through an automated product dispensation system. For example, larger objects may require a different angle of inclination or rotational speed for the auger delivering the product. Parameters of sensors in the product dispensing device may also need to be modified to account for the specific product being dispensed. The present application addresses these issues by first identifying the product being dispensed, and then determining suitable dispensation and/or sensor parameters at which the product should be dispensed to achieve maximum efficiency for a wide range of product geometries.

The disclosed methods and systems can be implemented within any device, for example, a product dispensing device. In an embodiment, the product dispensing device may include multiple augers to improve efficiency of dispensing by combining the individual efficiency of each auger. During experimentation, it was discovered that a first auger will distribute products at 70% efficiency (i.e., 70% of the test runs distributed one product, while 30% of the test runs distributed two to five products). Also, a second auger would individually distribute products at 80% efficiency. The second auger's increased efficiency was attributable to fewer products being transmitted through the auger. However, in combination, the two augers would obtain more than 90% efficiency due to the combined individual efficiency of the two augers. Although two augers are used in this system, a primary bulk auger could be used in series with another singulation/dispensing device. Additionally, more than two augers may be used to further improve efficiency in the case of smaller products or products that are more susceptible to decreased efficiency.

As shown in FIG. 1, a product dispensing device 100 is provided and includes a base 105 and a hopper 110 disposed at the top of the base 105. A touch-screen display 115, or other display, may be included at eye level to a user and above a scanner 120 that is capable of scanning a card carried by a user, for example, a magnetic, bar code, or RFID card. Below the scanner 120 is provided a dispensing area 125 where products are delivered. For holding products for sale, a shelf 130 is provided on the side of the base 105. To allow access to the internal components of the product dispensing device 100, a portion of the front of the base 105 may be coupled to the base, such as with hinges, and latched on the side with latches 135. In addition, an access point 140 can be provided adjacent or within the hopper 110 to allow for wireless or wired communication between the product dispensing device 100 and an external computer system.

The base 105 acts as the structural backbone of the product dispensing device 100 and can be made of any material, for example, metal, plastic, wood, or any other substance that allows for structural stability. In an embodiment, the base 105 is made of a powder-coated steel. As discussed above, the base 105 includes shelves 130 for holding products, and includes several openings for the user to scan a card (below the scanner 120), for the user to obtain the product dispensed (in the dispensation area 125), and an opening for a touch-screen display 115, such as a touch-screen display that is capable of interacting with the customers.

The hopper 110 is coupled to the base 105, and as described below with respect to FIG. 5, includes a hinged portion and a support portion. Products can be loaded into the product dispensing device 100 by placing the products inside an opening of the hopper 110 which communicates with internal features of the present invention to distribute the product to a consumer. The hopper 110 can be opened by the hinged portion and products can be distributed into the opening for future dispensation. Various ribs or deflector plates can also be provided inside the hopper 110 to control the flow of products from the hopper into the remainder of the product dispensing device 100.

Adjacent or inside the hopper 110 is the access point 140 which is operably coupled to an external computer. The access point 140 may include a transceiver that is capable of communicating through wired and/or wireless communications, for example, a telephone or Internet connection, a DSL connection, a cable connection, a 3G, 4G or other cellular communication method, a 802.11 wireless connection, or any other form of electronic communication.

The access point can communicate with an external computer to send the external computer data from the product dispensing device 100. For example, the access point 140 can transmit to the external computer data relating to the amount of product remaining in the product dispensing device 100, the number of scans on a particular day, what identification cards were scanned on a particular day, individual purchasing behavior of relevant consumers, or any other type of data that may be deemed useful. In addition, the external computer can communicate with the access point 140 to deliver information to the product dispensing device 100. For example, the external computer can communicate software updates to the product dispensing device 100 via the access point 140, or can communicate new instructions to the product dispensing device 100 that change the video or image displayed on the display 115. A service technician can also update the video or image displayed on the display 115 by scanning a "Program Changeover Instructional" card (or other identifying indicia) in the scanner 120 to effectively change the marketing material on the display 115 with the simple scan of a card.

The display 115 can visually depict video or images relating to the product that is dispensed from the product dispensing device 100, and can further display information for the user. For example, the display 115 can provide an advertisement for the product being dispensed and can include the instructions, such as, "Scan Card Now" or "Push Here for Instructions on How to Obtain a Card." By way of example, the display 115 can include a liquid crystal display (LCD), organic light-emitting diode (OLED) display, plasma screen, cathode ray tube display, or any other kind of black and white or color display that will allow the user to view and interpret information on the product dispensing device 100 and may further include touch-screen capabilities.

The scanner 120 can be any electrical, optical, RFID or electromagnetic device that can read a card or other sort of identification means. For example, the scanner 120 can be a bar code scanner, a magnetic card reader, a fingerprint reader, a magnetic strip reader, a smart card reader, RFID reader, or any other form of apparatus that allows identification to be verified. In a preferred embodiment, the scanner 120 is a barcode scanner that reflects light off of a barcode through an opening in the base 105 on to the user's card. Alternately, the scanner 120 can transmit light off of a mirror or set of mirrors and on to the user's card. The light from the scanner 120 can either be constantly transmitted to the area at which the user scans a card, or can be activated once a sensor is tripped to notify the sensor that a card is present.

As discussed herein, the user can scan a card with an identification number to dispense a product from the product dispensing device 100, or can otherwise command the product dispensing device 100 to dispense a product. In an embodiment, the user scans a barcode on a card to command the product dispensing device 100 to dispense the product. However, the card can be any form of electrical, optical or electromagnetic card capable of being scanned by the scanner 120. Further, the card need not be a free sample card, but can be a credit card, debit card, contactless payment methods, or other method capable of transmitting money, points, or other currency derivative to the product dispensing system 100 to thereby purchase the product contained in the dispensing system 100. A user can also verify their identity without a card, for example, by scanning a fingerprint or other biometric identifier, by using a mobile phone or other portable electronic device to send a text message or other electronic signal, by transmitting identifying data via a Bluetooth connection, by user input to the display 115, or any other activation method.

The dispensation area 125 can be disposed below the scanner 120 and can be the end point of products dispensed through the product dispensing device 100. When a product is delivered to the dispensation area 125, a light may flash to alert the user that the product has arrived and is ready for retrieval by the user. Alternately, the display 115 or a sound can alert the user that their product is in the dispensation area 125, or such alerts can be provided by emitting a sound.

One or more shelves 130 can be provided on the base 105 to hold additional products thereon. As shown, the shelves 130 are provided on the side and the bottom of the base 105. However, the product dispensing device 100 need not have any shelves 130, or such shelves 130 can be provided independent of the product dispensing device 100 (for example, on standard shelving at grocery stores) to allow for a smaller footprint of the product dispensing device 100.

The delivery system 200 of the present invention will now be discussed with reference to FIGS. 2A-2D. As shown, the delivery system 200 includes an elbow 205, a bulk auger 210, a dispensing chute 215 and a delivery auger 220 disposed on a frame 225. To facilitate movement of the augers 210, 220, one or more motors 230 can be provided that are adapted to engage with the augers 210, 220 in order to rotate the augers 210, 220. Of course, the motors 230 need not engage with their respective augers 210, 220 at the same time. Further, one or more sensors 233*a-e* can be provided on the delivery system 200 to determine the location or amounts of products within the product dispensing device 100. Agitators 235 can also be provided to shake the various components of the delivery system 200 and dislodge products that have coagulated together or are otherwise lodged in place.

The elbow 205 can be shaped as a quarter circle scoop and can receive from the hopper 110 the products that are to be dispensed through the product dispensing device 100. As shown, the elbow 205 is in the closed position. However, the elbow 205 can be hinged to the frame 225 or any other part of the product dispensing device 100, and can rotate away from the bulk auger 210 to allow a serviceman to purge the elbow 205 and/or retrieve the contents of the bulk auger 210. To hold the elbow 205 closed, a flexible cord (e.g., a bungee cord) can be attached to the frame 225 and to the cord attachment 240. Other means of securing the elbow 205 in a closed position can also be used, such as, for example, latches, locks, magnets, and the like. A serviceman can thus easily undo the cord from the frame 225 and purge the elbow 205.

After a product is dispensed through the elbow 205, the product can enter the bulk auger 210. As used throughout this application, the term "auger" means an inverted auger that includes an outer barrel and internal spiral flighting extending at least partially from one open end of the barrel to the other open end of the barrel. The inverted auger of the present application allows an internal wall of the outer barrel to rotate which, in turn, rotates the flighting inside the barrel. The flighting can be either integral with or attached to the outer barrel.

The inverted auger design is advantageous to that of conventional augers. Conventional augers include a fixed barrel that does not rotate. Rather, in a conventional auger, contents are transported using a spiral flighting that rotates within the fixed barrel. The conventional fixed barrel design produces several undesirable pinch points between the flighting and the barrel that can damage the product being dispensed. In contrast, the auger of the present application rotates the barrel together with the spiral flighting, creating fewer pinch points and reducing the risk of product damage.

Figure 3A:
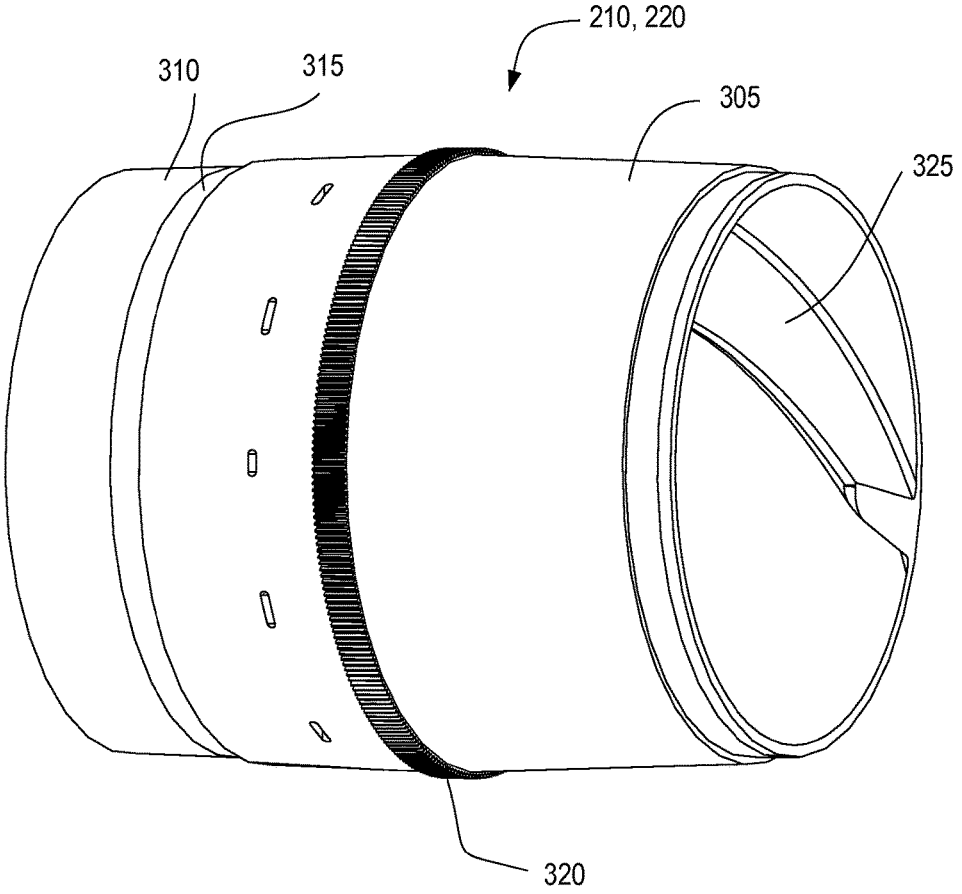
FIGS. 3A-3C illustrate an inverted auger for a dispensing device.
Figure 3B:
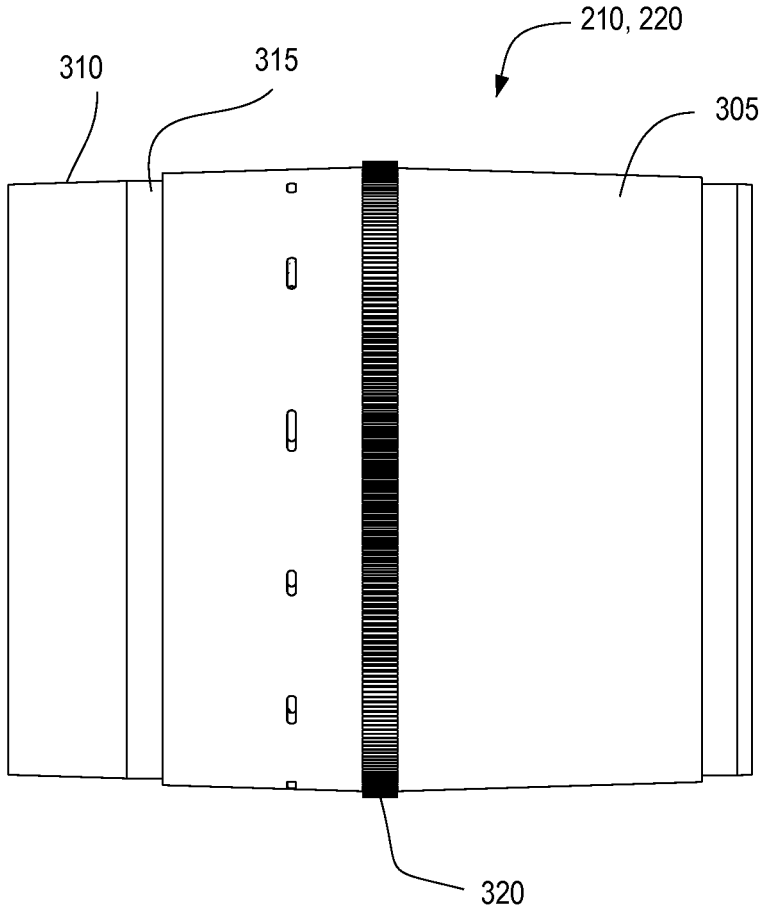
Figure 3C:
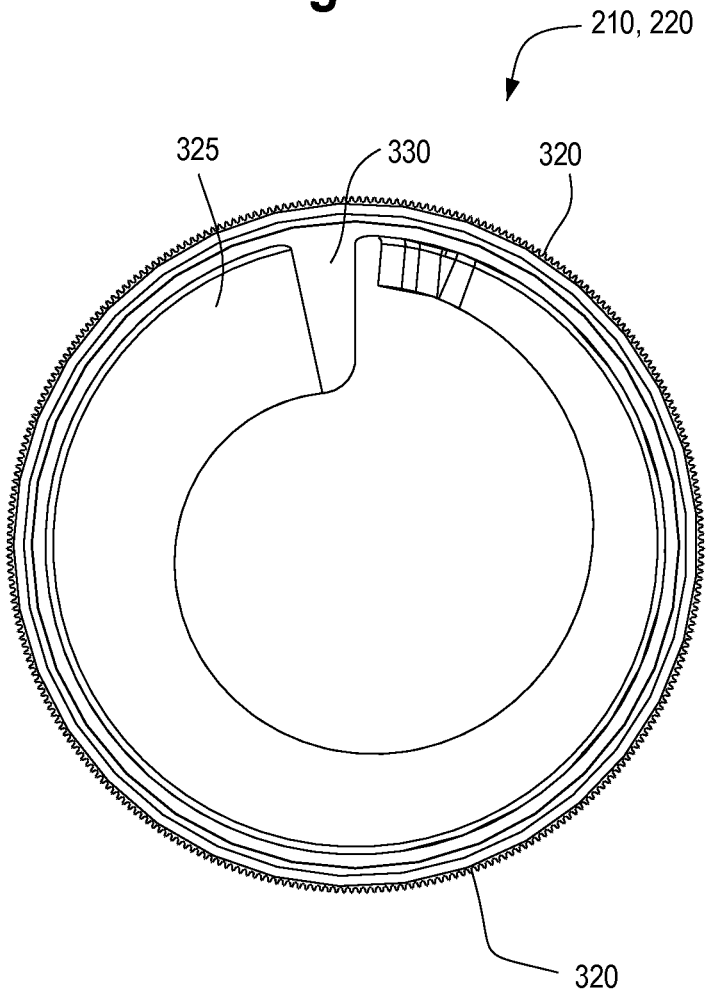

As shown in FIGS. 3A-3C, the augers 210, 220 include a main body 305, lower body 310 and a ridge 315 on the outer surface of the auger 210, 220. Further, a worm gear 320 can be provided on the auger 210, 220 for engaging the motor 230. The auger 210, 220 can be a single injection-molded device or can be fastened together by two or more components. On the inside of the auger 210, 220, spiral flighting 325 is provided with an extending portion 330 that can be located on at least one of the ends of the flighting 325. Mechanical activation of the augers 210, 220 can be by other mechanical means including an axial gear drive, a friction wheel (i.e. rubber wheel on the outer surface of the auger), belt drive or any other appropriate means.

As shown, the main body 305 is displaced from the lower body 310 by way of a ridge 315. The ridge 315 allows for the auger 210, 220 to fit within the frame 225 and rotate therein. The auger 210, 220 also includes two open ends with spiral flighting 325 extending from one open end to the other open end and facilitating movement of individual products from one of the open ends to the other. For example, a product loaded into the hopper 110 can be transferred to the elbow 205, and can thereafter pass into a first open end of the bulk auger 210. The bulk auger 210 can transfer the product to the second open end of the bulk auger 210 and into the dispensing chute 215 by rotating the auger 210 together with the integral or attached spiral flighting 325.

As best shown in FIGS. 3A and 3C, the spiral flighting 325 can include the extending portion 330 on at least one end thereof to grip products as they enter the auger 210, 220 or to separate two of the products so that only one of the products is transferred. The extending portion 330 can be any shape or size that allows for gripping and separation of products. As shown, the extending portion 330 extends at an angle from the spiral flighting 325, i.e., at an angle parallel to the first and second open ends of the auger 210, 220.

As discussed above, the tapered nature of the flighting 325 can contribute to the efficiency of the delivery system 200, together with the friction, rotating speed, angle of inclination, and rotating amount of the auger 210, 220. For example, the flighting 325 can have a flighting height that decreases from the inlet opening to the outlet opening of the auger 210, 220. In a preferred embodiment, the flighting height is two inches at the inlet of the auger 210, 220 and is one-half inch at the outlet of the auger 210, 220. These preferred dimensions represent flighting heights that are adaptable to a variety of products dispensed through the delivery system 200, and different heights can be implemented for different sized or shaped products. The tapered nature of the flighting 325, in combination with the inclination of the auger 210, 220, tends to allow only one product to travel on the flighting 325 nearest the outlet of the auger 210, 220. When multiple products are moved from the inlet to the outlet of the auger 210, 220, the decreasing width of the flighting 325 causes only one sample to be "gripped" and the others to flow towards the inlet of the auger 210 based on gravity.

Various processes can be implemented to increase or decrease the friction of the inside surface of the augers 210, 220. For example, a layer of friction-reducing material, such as Teflon®, may be provided on the inside surface of the auger 210, 220 to reduce the friction to the level necessary to facilitate easy movement of the products. On the other hand, a separate high-friction coating layer may be attached to the inside surface of the auger to increase the friction of the internal surface, if needed. Any other method of increasing or decreasing the friction within the auger 210, 220 can be used within the spirit and scope of the present application.

Figure 2A:
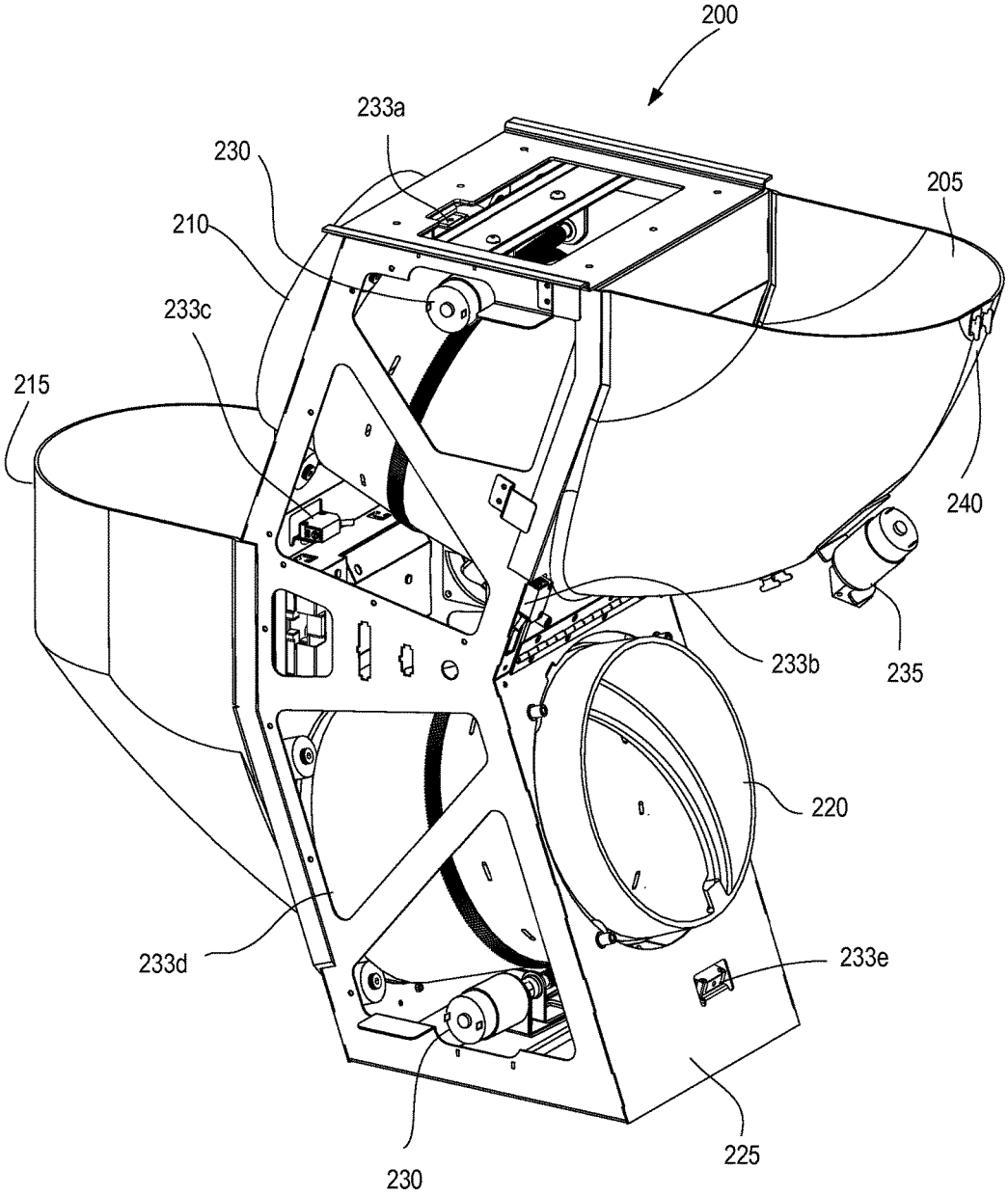
FIGS. 2A-2D illustrate a delivery system for a dispensing device.
Figure 2B:
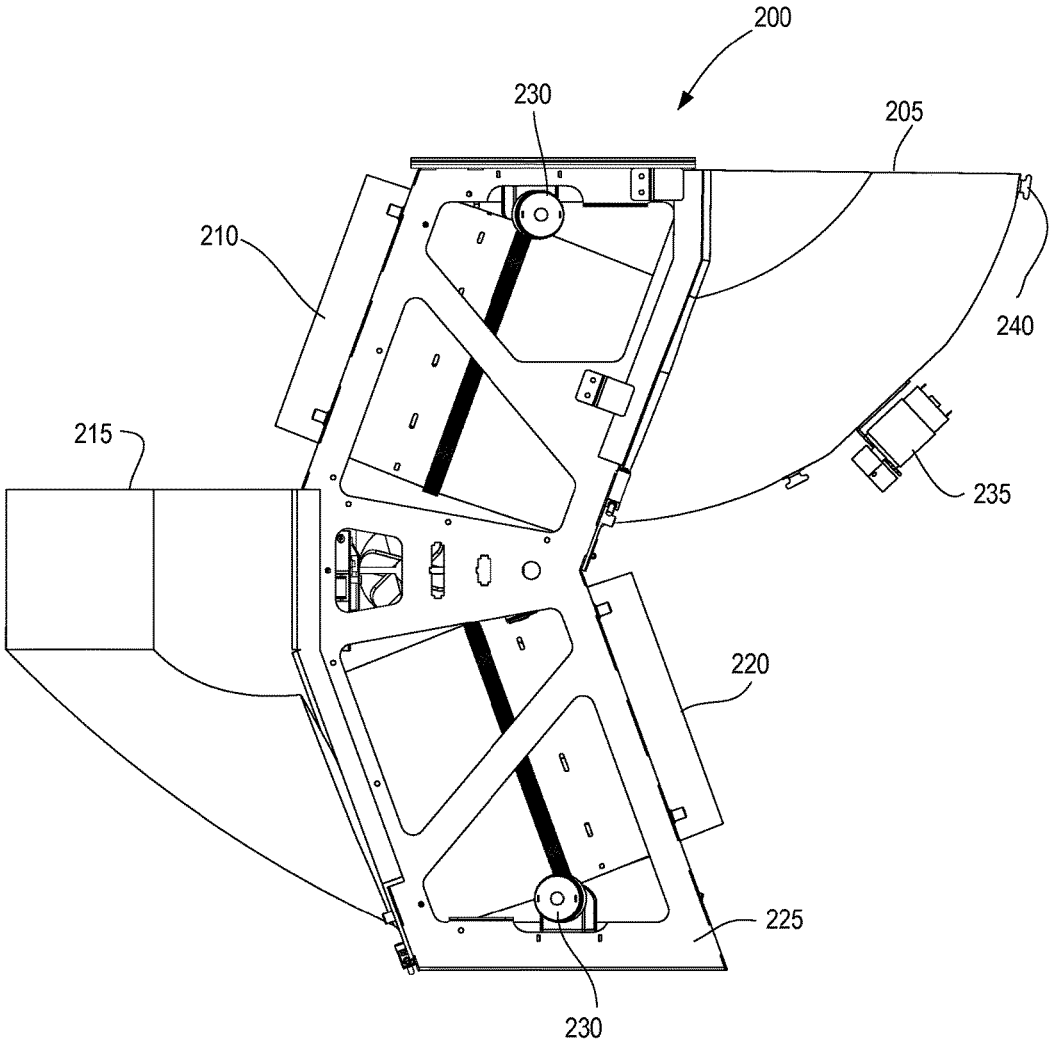

As shown in FIG. 2B, the bulk auger 210 and delivery auger 220 are inclined at an angle relative to the ground plane. The angle of the augers 210, 220 holds the separated products within the auger in a seriatim fashion rather than dispensing all the products at once. To achieve maximum efficiency (i.e., to dispense only one product at a time), the optimal friction, rotating speed, and angle(s) of the augers 210, 220 have been determined for each type or size of product. The preferred inclined angle for the augers 210, 220 is approximately 0-30°, and more preferably 20°, relative to the ground plane, for most products. The flighting 325 is also designed for optimal efficiency by its tapered nature. The angle of the flighting 325 surfaces can be adjusted to better grip a product and dispense it to the customer. Further, the flighting 325 can extend a particular length to better grip the product.

Figure 2C:
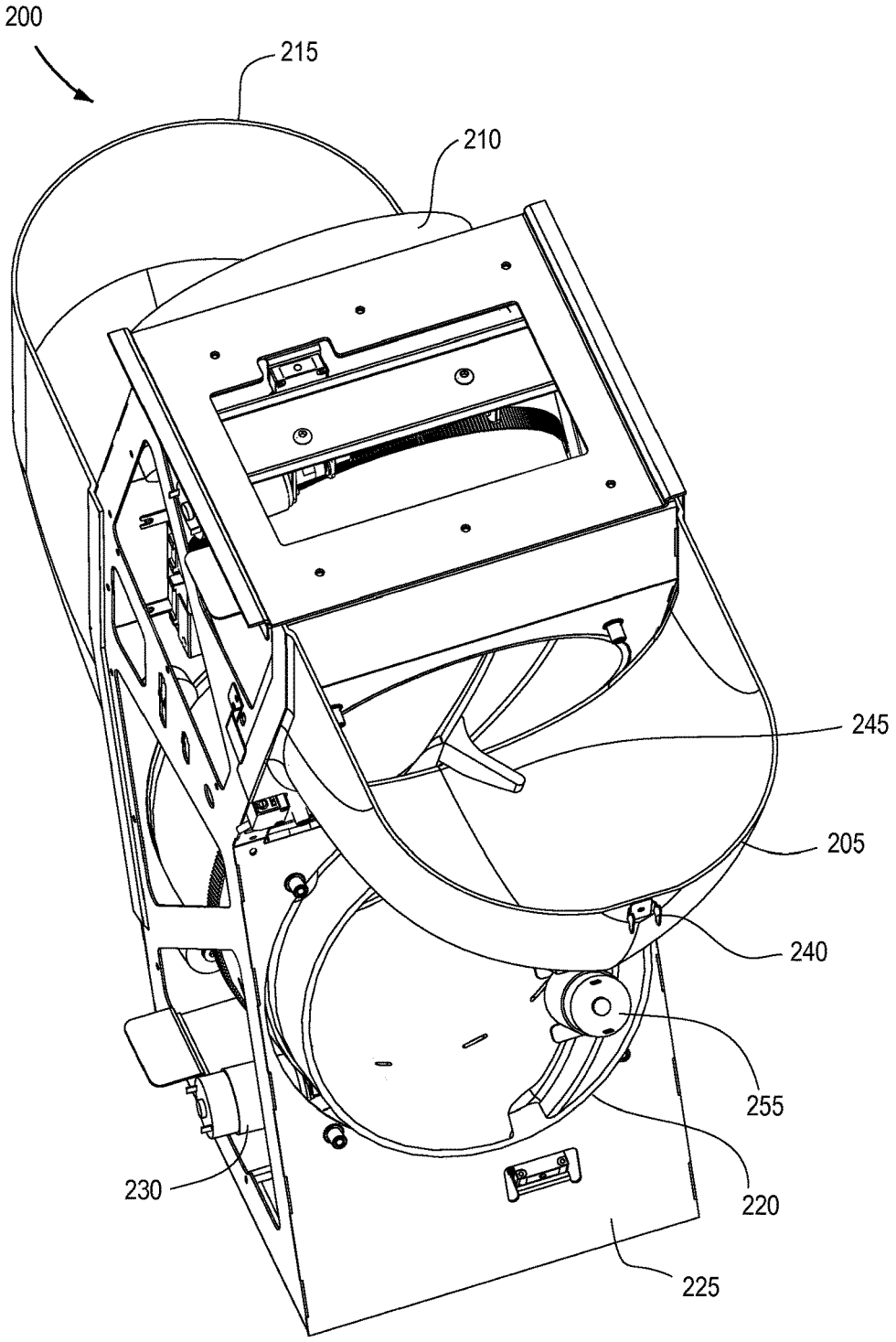

A tongue 245 can be attached to either one of the bulk auger 210 or the delivery auger 220 and can rotate within either the elbow 205 or the dispensing chute 215, respectively, to disengage products that may have coagulated with one another or that are otherwise lodged within the delivery system 200. As shown in FIG. 2C, the tongue 245 is attached to the bulk auger 210 and can rotate with the bulk auger 210 to move along or "scrape" or otherwise abut the surface of the elbow 205 and dislodge the contents therein. The tongue 245 can also "grip" a product to allow for easier individual dispensation of a product.

Figure 2D:
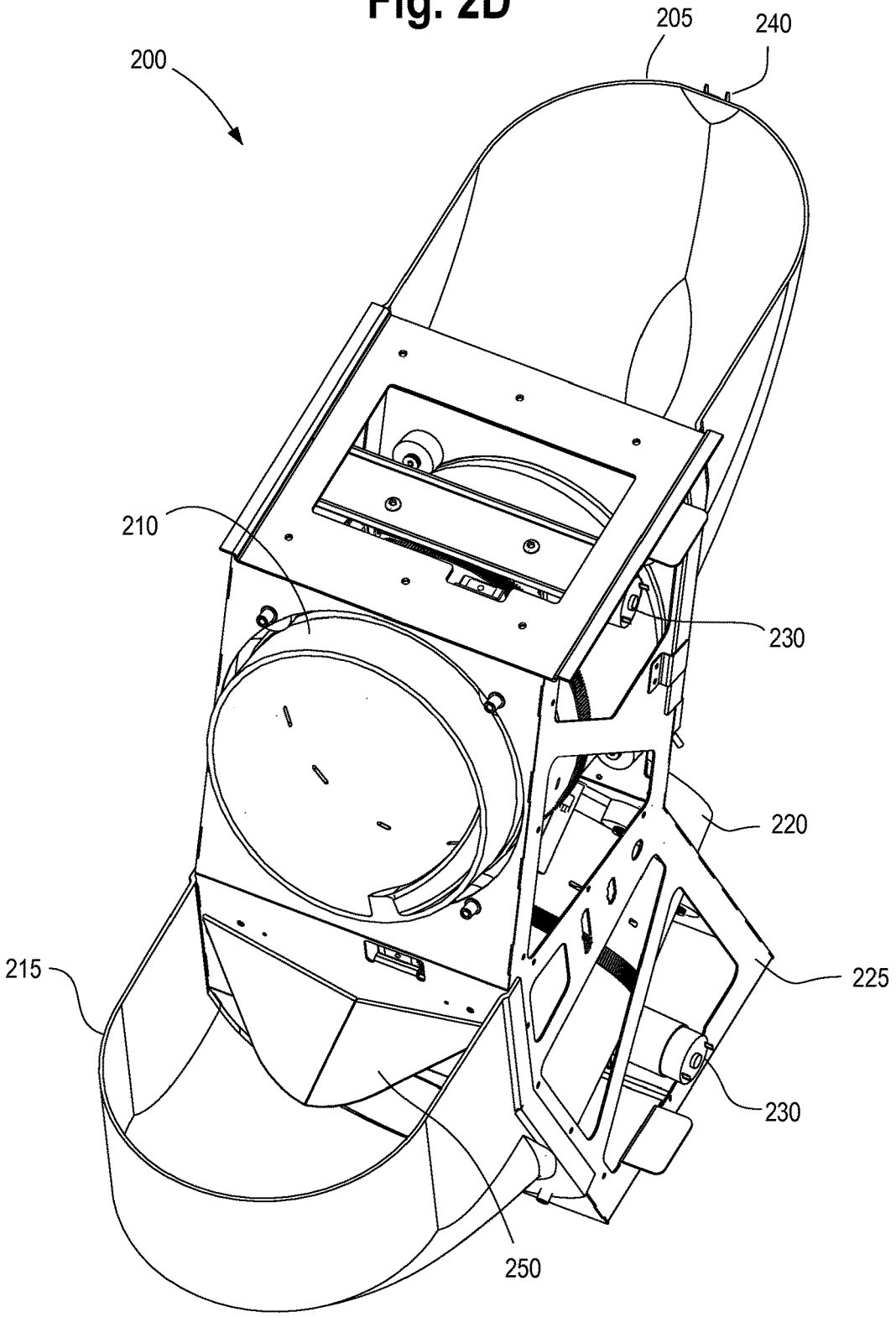

After a product is transferred through the bulk auger 210, the product enters into the dispensing chute 215. As shown in FIG. 2D, a channel 250 can be provided to facilitate entry of a product into the dispensing chute 215 in a serial manner without requiring a serviceman to individually load the product. The channel 250 may be a V-shaped piece of sheet metal or funnel-like structure that directs the product in one area of the dispensing chute 215.

As shown, the dispensing chute 215 is provided at its first open end below an exit path of the bulk auger 210, and communicates at its second open end with the entrance opening of the delivery auger 220. Products can therefore be delivered from the bulk auger 210 into the dispensing chute 215 and then to the delivery auger 220.

Similar to the bulk auger 210, the delivery auger 220 rotates and by way of the spiral flighting 325 provided in the delivery auger 220, can dispense the product out of the second open end of the delivery auger 220 and into the dispensation area 125. As shown in FIG. 3A, the bulk auger 210 and the delivery auger 220 can include substantially similar structure and configuration. However, it is understood that the bulk auger 210 and the delivery auger 220 can be made of different structures without departing from the spirit and scope of the present invention. For example, as discussed above, it is preferred that the bulk auger 210 and the delivery auger 220 are inclined at an angle of approximately 20° to the ground plane. However, the augers 210, 220 may be disposed at different angles from the ground plane consistent with the spirit and scope of the present invention. In addition, the augers 210, 220 can rotate simultaneously by way of the motors 230, or can rotate at different timing or speeds to one another. Other properties of the auger (material, friction, rotation speed, flighting 325 properties, and others) can also be varied without departing from the spirit and scope of the present application. For example, as discussed below with respect to FIG. 7, an optimization method can be implemented to apply the most efficient parameters as the auger 210, 220 properties.

The motor 230 facilitates movement of the auger 210 by engaging with the worm gear 320 provided on the outer circumference of the auger 210, 220. As shown, the motor 230 is a worm motor, but any type of electrical or mechanical motor may be provided within the spirit and scope of the present invention. Further, magnetic actuation may be provided to rotate the auger 210, 220 at a preferred speed, acceleration and timing.

The sensor 233*a-e* can be an optical sensor that senses whether an object, such as a product, is present in the hopper 110, the elbow 205, the dispensing chute 215 or either of the augers 210, 220. For example, a sensor 233*a-e* can be provided above the delivery auger 220 to sense objects within the delivery auger 220. However, sensors 235 can be provided within or outside of the different components of the delivery system 200 to sense objects within the hopper 110, the elbow 205, the bulk auger 210, the dispensing chute 215, or the delivery auger 220, or any combination of the above.

The sensors 233*a-e* can actuate various agitators 235 to dislodge products that have been lodged in the system or have coagulated with one another. For example, the agitator can be an off-balanced or eccentric weight that is connected to a motor, and where the motor vibrates the weight in order to agitate the products therein. The agitator can be activated by either manual actuation (i.e., by way of the touch-screen display 215) or automatically if one or more of the sensors 233*a-e* detect that products are not being dispensed properly.

The sensors 233*a-e* can be located inside the delivery system 200 component itself, or can be positioned outside of the component but in a position to sense objects within the component. For example, the sensor 233*a-e* can be connected to the elbow 205 but sense objects within the delivery auger 220. However, the sensor 233*a-e* could be located directly within the delivery auger 220 to sense objects therein. Other sensor combinations can be implemented to determine the location of product(s) or the functionality of the delivery system 200 without departing from the spirit and scope of the present invention.

The sensors 233*a-e* can be connected to one another such that the location of products within the delivery system 200, if any are present, can be determined. For example, a first sensor 233*a* can be provided to sense objects in the hopper 110, a second sensor 233*b* can be provided in the elbow 205, a third sensor (not shown) can be provided at an inlet opening of the bulk auger 210, and a fourth sensor (not shown) can be provided in the outlet opening of the bulk auger 210. Additional sensors 233*c-e* can be provided in other areas of the delivery system 200. Also, a similar sensor 233*a-e* configuration can be provided in the dispensing chute 215 and delivery auger 220. For example, if the second sensor 233*b* in the elbow 205 does not sense a product but the first sensor 233*a* senses that objects are present in the hopper 110, the delivery system 200 will determine that products are lodged in the hopper 110 and will actuate an agitator in the hopper 110 to dislodge the products. Similarly, if the third sensor fails to sense any product in the bulk auger 210 but the second sensor 233*b* senses products in the elbow 110, the delivery system 200 can actuate the agitator 235 in the elbow 110 and dislodge products in the elbow. Within the bulk auger 210, if products are sensed at the inlet opening but not at the outlet opening, the tongue 245 can be actuated to dislodge products that are within the bulk auger 210. If all of the sensors 233*a-e* fail to detect any product, the delivery system 200 will determine that no products are available to be dispensed and will issue an "Out of Product" notice to the consumer and/or the service technician. Of course, the above example was applied to only the hopper 110, elbow 205, and bulk auger 210, but the present application is not so limited. The general concept of communicating information from downstream sensors 233*a-e* to upstream agitators can be implemented in any way and in combination with any component of the present application.

Another application of the sensors 233*a-e* is to save power that is applied to the augers 210, 220 and to avoid over-rotation of the augers 210, 220. When a product is dispensed through the delivery system 200, the bulk auger 210 can rotate until the product is sensed by a sensor 233*c* located in or around the dispensing chute 215. Once the product is sensed in the dispensing chute 215, the delivery system 200 knows that the product has exited the bulk auger 210 and thus stops rotation of the bulk auger 210. The same principle can be applied to the delivery auger 220 as well—rotating the delivery auger 220 until a product is sensed at either the outlet opening of the delivery auger 220 or downstream in the product dispensation area 125. Other combinations of the above can be implemented within the spirit and scope of the present invention.

As shown, the delivery system 200 includes two augers—a bulk auger 210 and a delivery auger 220. However, the present application is not limited to a two auger system, and can include one, two, three, or more augers. For example, a single auger can be implemented and can include substantially the same structure as the bulk auger 210 or the delivery auger 220. The single auger can include a barrel portion and internal flighting that is either integral with or attached to the internal wall of the barrel portion. The auger can thus rotate as a whole—with both the barrel and flighting rotating together—to reduce pinch points and avoid substantial damage to the product as compared to the conventional fixed barrel and rotating flighting design.

The single auger system can distribute products more efficiently by manipulating the properties of the products themselves. For example, the size, weight, shape, volume, or friction of the products can be altered to improve the efficiency of distribution through the single auger or multiple auger system. The single auger system can also be implemented in combination with another singulation device that dispenses objects in a singular fashion or that divides bulk-loaded objects into single samples, for example, a dividing barrier or ramp.

Figure 6:
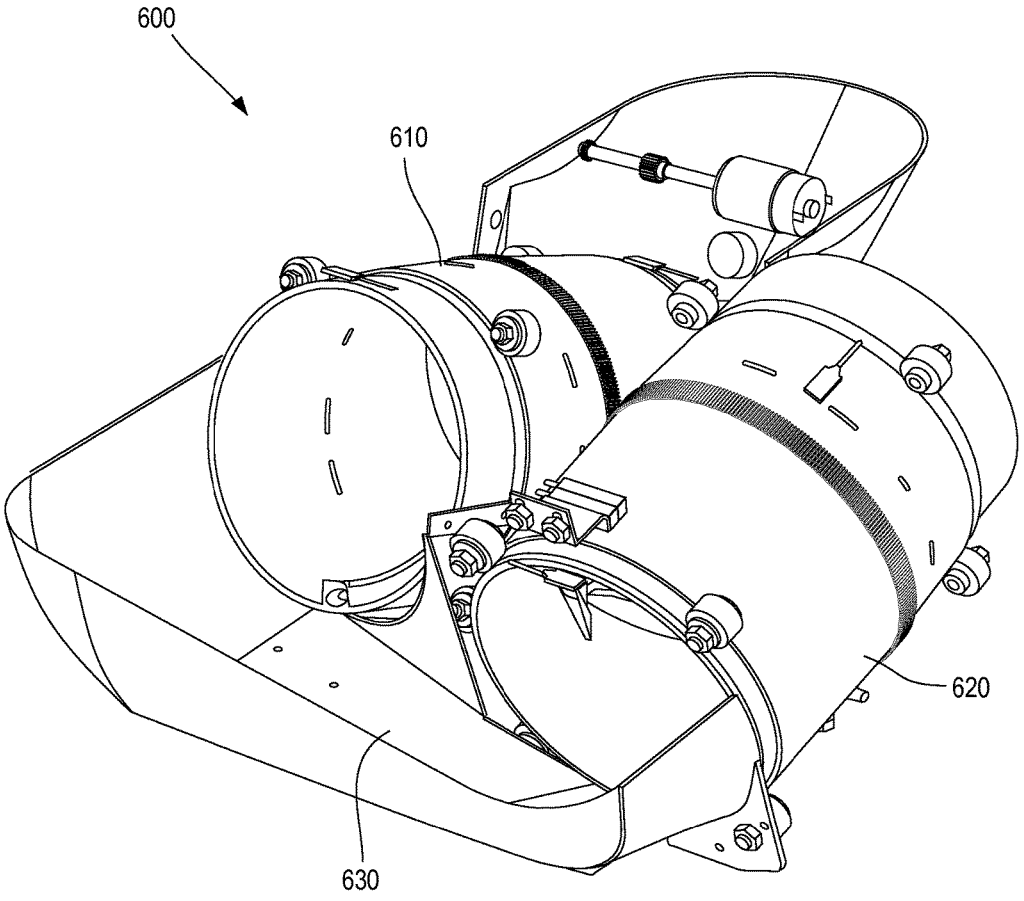
FIG. 6 illustrates a horizontal auger for a dispensing device.

As shown, the delivery system 200 includes multiple augers 210, 220 with the bulk auger 210 directly above the delivery auger 220. However, as shown in FIG. 6, another type of delivery system 600 can include augers 610, 620 disposed horizontal to one another and communicating with one another via a deflector plate 630. Products can thus be dispensed into the hopper 110 and eventually be transmitted to the bulk auger 610. The bulk auger 610 can then rotate and transfer the product, by way of the transfer ramp 630, into the delivery auger 620. The delivery auger 620 thereafter rotates and dispenses the product into the product dispensation area 125. The horizontal auger embodiment is advantageous for spacing purposes where a more vertical design is not plausible, e.g. in a low ceiling area.

Figure 4A:
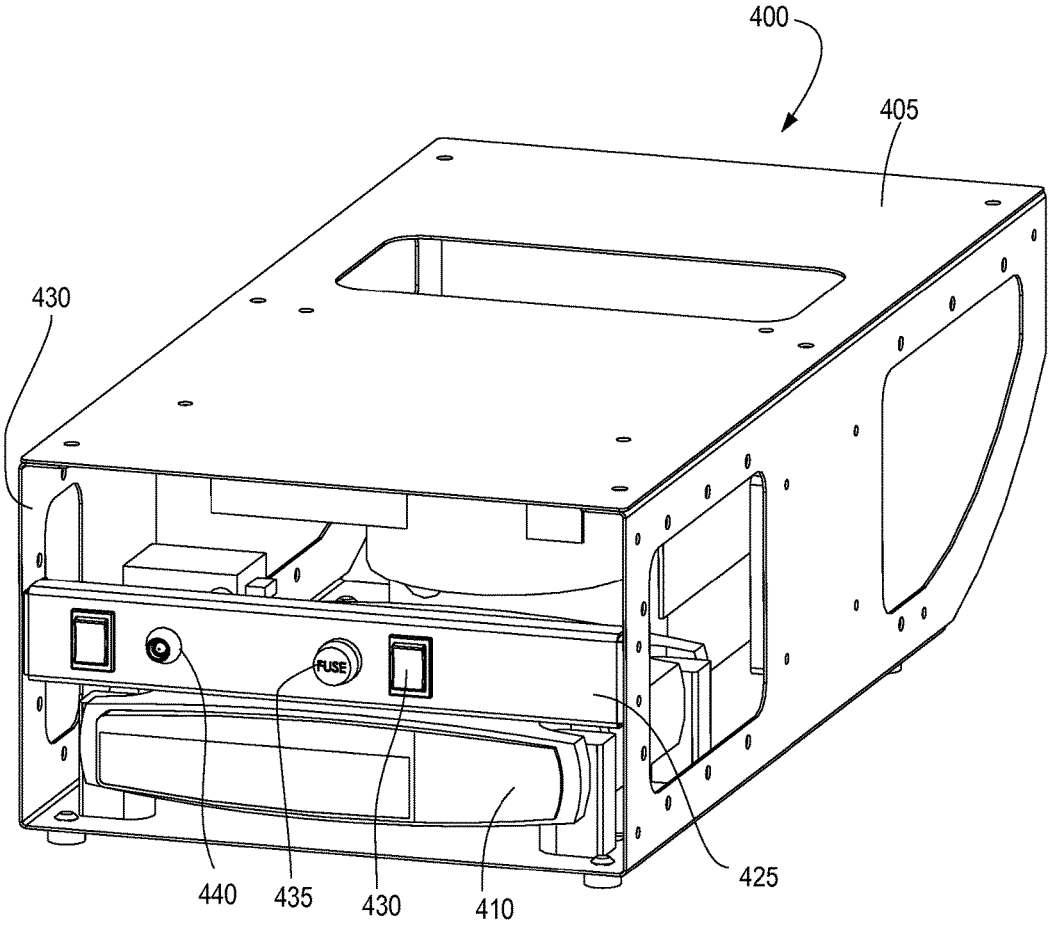
FIGS. 4A-4B illustrate an electronic console for a dispending device.
Figure 4B:
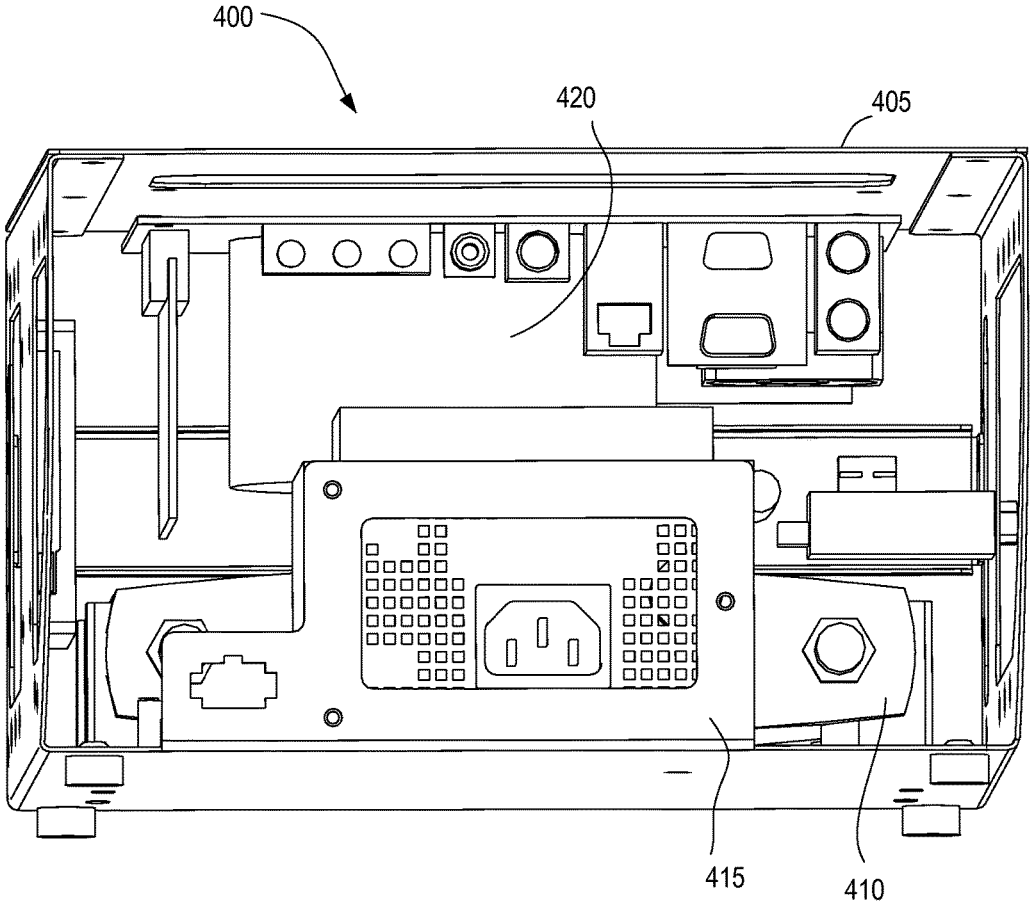

With reference to FIGS. 4A and 4B, an electric console 400 of the present application is disclosed. As shown, the electric console 400 includes a bracket 405 that acts as a backbone for the contents of the electric console 400. A wireless router 410, power source 415, mother board 420 and a mounting plate 425 can be attached to the bracket 405. Attached to the mounting plate 425 are one or more switches 430, a fuse 435 and a functionality indicator 440.

The power source 415 can deliver power to the electrical components of the product dispensing device 100, for example, the display 115 and the scanner 120. In addition, the power source 415 can supply power to the delivery system 200 or the delivery system 200 can include its own power source and electric console. In a preferred embodiment, the power source 415 is connected to a standard wall socket or surge protector to provide electrical power to the product dispensing device 100.

The power source 415 can also include a battery that is operative to power the product dispensing device 100 when the motherboard 420 determines that the product dispensing device 100 is not being adequately powered by the standard wall socket connection. Optionally, when the power source 415 switches from a standard wall socket connection to a battery connection, the access point 140 may contact an external computer and notify the necessary personnel that the product dispensing device 100 is operating on temporary power.

The motherboard 420 provides the controlling backbone of the product dispensing device 100 and includes computer components necessary for the product dispensing device 100 to function. For example, the motherboard 420 can include a memory and a processor for transmitting video or images to the display 115, data relating to the number of times a user has swiped their card, data relating to the maximum number of user accesses that are permitted, or any other form of relevant data.

The motherboard 420 can also store the general operating system for the product dispensing device 100 and can control functionality of the scanner 120 and delivery system 200. For example, the motherboard 420 can instruct the delivery system 200 to rotate the augers 210, 220 at a precise speed or speeds determined based on the friction and angle of inclination of the augers 210, 220 and status of the sensors 233*a-e*. Various algorithms may be stored in the memory of the motherboard 420 to determine the necessary speed and timing of rotation for the augers 210, 220, which, as discussed above, can vary between the augers 210, 220, depending on the product being dispensed. Alternately, a separate motherboard 420 may be provided with the delivery system 200 for precise controlling of the delivery system 200.

The motherboard 420 can transmit data stored in its memory to an outside computer as necessary. For example, when the memory is almost full, the motherboard 420 can communicate with the access point 120 and transmit the contents of the memory to an outside computer. In this manner, the outside computer can store data relating to the number of accesses for a particular product, the amount of product remaining, or other operating parameters without requiring a visit to the product dispensing device 100. The motherboard 420 can also transmit memory contents to an internal or external permanent storage when the motherboard 420 determines that the power source 415 is running on battery power.

The mounting plate 425 can include one or more switches 430 for actuating electrical components attached to the product dispensing device 100. In addition, a fuse 435 can be provided for protecting the product dispensing device 100 against electrical surge, and a functionality indicator 440 can be provided to indicate whether the electrical components of the product dispensing device are operating effectively.

The motherboard 420 can also include a coupon dispensing program to dispense a product coupon to a user, typically for the product being dispensed through the product dispensing device 100. For example, the motherboard 420 can store and execute a coupon distribution program to dispense coupons to the customer via a coupon printer (not shown) or wirelessly to the card or other identifying indicia of the user. The coupon can provide additional discounts to the user of the device 100 for extra incentive to purchase the product.

The coupon dispensing program can vary the dispensing process from consumer to consumer. For example, the coupon distribution program can identify the buying habits of the consumer as they pertain to the product being dispensed. Naturally, a consumer who frequently purchases the product being dispensed would need a smaller incentive to purchase the product again based on their frequent buying habits. However, a consumer who has not yet purchased the product may need an additional incentive. The product dispensing program can thus identify the user, analyze their buying habits based on data transmitted to or stored by the motherboard 420, and can selectively dispense or omit dispensing a product coupon to a user. Any other method can also be used to control shopper behavior based on incentivized discounts, in addition or alternatively to the above.

The motherboard 420 can also include the necessary programming and hardware to facilitate payment by a customer or user for product contained in the product dispensing system 100.

Figure 5:
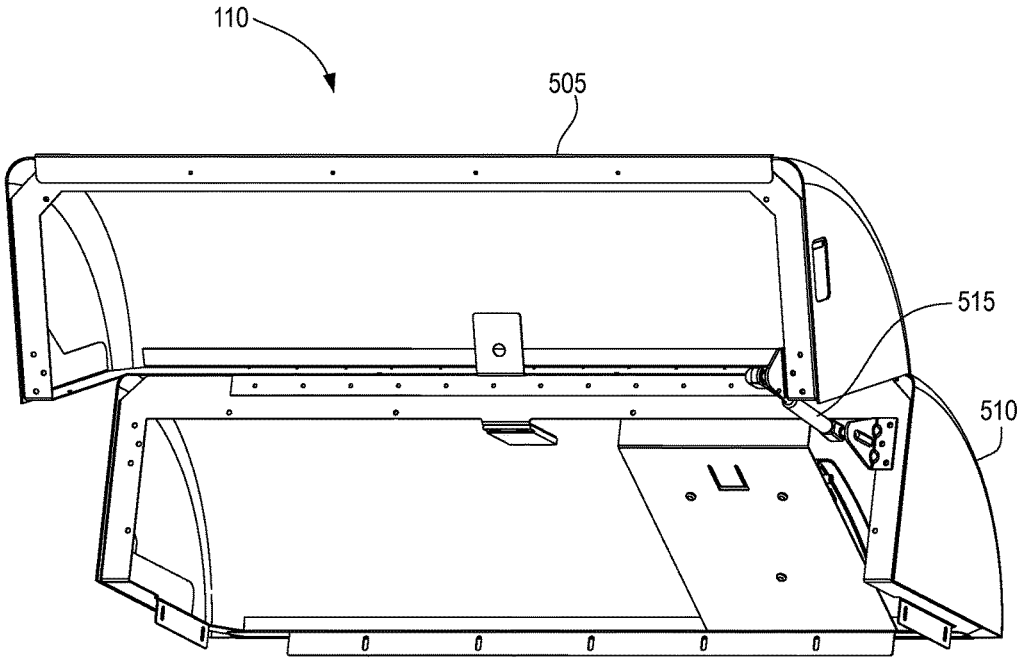
FIG. 5 illustrates a hood allowing access to a hopper of the product dispensing device shown in FIG. 1.

A hopper 110 in accordance with the present invention is shown in FIG. 5. As shown, the hopper 110 includes a lid 505 and a support 510 attached by way of a hinge. A cylinder 515 is also provided and is connected to both the lid 505 and support 510 for resisting the force of gravity when the lid 505 is in the upward position. The cylinder 515 may also include a locking mechanism (not shown) for locking the cylinder 515 in place when the lid 505 is in the open position.

A process of using the product dispensing device 100 will now be discussed. A user can transmit an identification number to the product dispensing device 100 by, for example, scanning a bar code on a card. The motherboard 420 of the product dispensing device 100 will then determine whether the identification number has already been scanned the maximum number of times or if the identification number listed on the identification card can be dispensed a product from the product dispensing device 100. If the card is eligible to dispense a product, the motherboard 420 will cause the motors 230 to rotate a predetermined amount, at a predetermined speed and at a predetermined time based on the speed and friction of the augers 210, 220 and type of product being dispensed, so as to deliver a product from the hopper 110 through the bulk auger 210, into the dispensing chute 215, so a single product is then delivered into the delivery auger 220.

Again, the motors 230 need not rotate both augers 210, 220 at the same time, and in a preferred embodiment will rotate the bulk auger 210 prior to rotating the delivery auger 220. This reduces the amount of electricity that is used when the auger(s) 210, 220 is rotated but products are located in areas of the delivery system 200 other than the rotating auger(s) 210, 220. Once the delivery auger 220 rotates a predetermined amount and/or speed, a single product is dispensed in the dispensation area 125 where the user can retrieve the product.

If the user scans their card and the motherboard 420 determines that the card is not eligible for product dispensation, the display 115 will alert the user that the product will not be dispensed and that the card has been denied. The display 115 may then give the user instructions for how to obtain a new card, or the reasoning behind why the card was denied (e.g., the card could not be scanned because of a functional error).

A method of servicing the delivery system 200 according to the present application will now be discussed. A serviceman can open the door of the product dispensing device 100 to access the inside of the product dispensing device 100 by disengaging the latch 135 as shown in FIG. 1. The serviceman can then release the cord on the cord attachment 240 and rotate the elbow 205 away from the bulk auger 210 so as to allow the serviceman to purge any products from the elbow 205 and bulk auger 210 upon rotating the elbow 205, the serviceman can also view the contents of the augers 210, 220, and remove any contents from the augers 210, 220. The serviceman can then rotate the elbow 205 upward and against the frame 225, and can reattach the elbow 205 to the frame 225 by way of, for example, a bungee cord. Following this step, the serviceman can then load the hopper 110 with a plurality of products by placing the products loosely into the hopper 110, rather than having to load the hopper 110 one-by-one with products.

Should the serviceman need to change the video or image on the display 115 (e.g., if the new product is being dispensed by the product dispensing device), the serviceman can either do so manually at the site of the product dispensing device 100 or can transmit electronic instructions to the product dispensing device 100 by way of the access point 140. For example, the service technician can scan a card to change the video or image on the display 115, and to otherwise reprogram the product dispensing device 100 to depict a new product. Alternately, the motherboard 420 can include predetermined instructions to change the contents of the display 115 at a predetermined time to facilitate a change of product being dispensed.

A computer-readable recording medium can be contained within the motherboard 420 (e.g., as the "memory" discussed above) or within the external computer, and can store a computer program that optimizes the efficiency of the dispensing device 100 based on the product being dispensed. The computer-readable recording medium can store any data or computer programs for use in the dispensing device 100. For example, the computer-readable recording medium can store a computer program for optimizing the performance of the dispensing device 100. The computer-readable recording medium can also store an operating system for the dispensing device 100 or any other software or data that may be necessary for the dispensing device 100 to function. Without limitation, the computer-readable recording medium can include any non-transitory computer-readable recording medium, such as a hard drive, DVD, CD, flash drive, volatile or non-volatile memory, RAM, or any other type of data storage.

Figure 7:
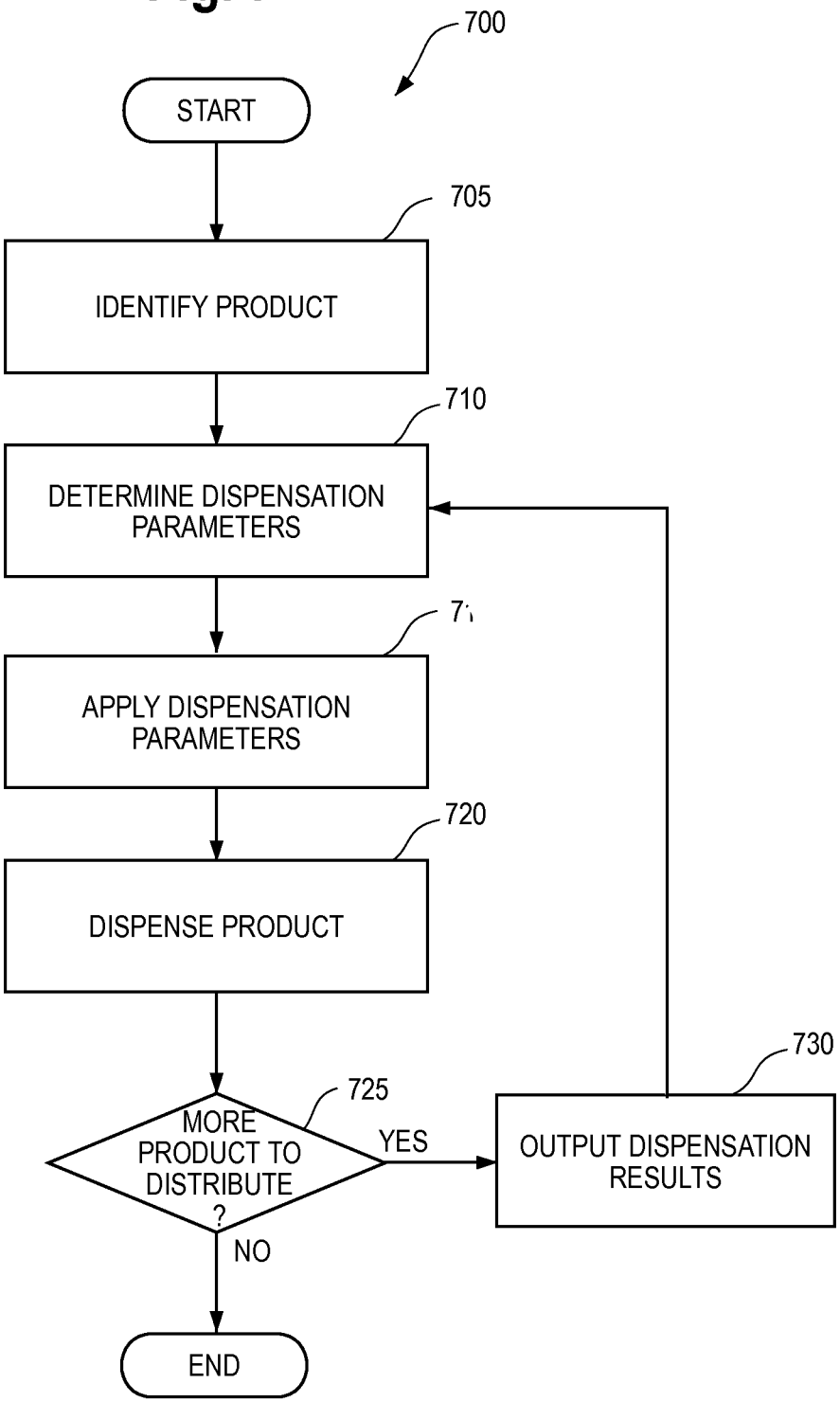
FIG. 7 illustrates a flow chart showing a process according to an embodiment of the present application.

FIG. 7 illustrates a process 700 for optimizing the delivery of products through the dispensation device 100. As shown, the process begins and proceeds to step 705, where the product that is to be dispensed is identified. Any manner of identifying the product can be implemented without departing from the spirit and scope of the present application. For example, the product can be identified by user input into an interface on the product dispensation device, by scanning a card having a barcode with the scanner 120, by scanning a bar code present on the product, by transmitting a signal with a portable electronic device (e.g., through an application or by transmitting a text message), through RFID or magnetic means, or in any other manner.

The process 700 then determines the appropriate dispensation parameters in step 710 to optimize singular dispensing of the product. Here, the process 700 determines the parameters that would dispense the product in the most efficient manner based on the geometry, size, shape, and/or weight of the product, or prior data relating to the product. Without limitation, such parameters can include the rotational speed, angle of inclination, or amount of rotation for the augers 210, 220. Alternately, or in addition to the above, the process 700 can determine friction modifications of the augers 210, 220 that would achieve optimum dispensation efficiency to ensure singular product dispensing. For example, the process 700 can determine that a friction-reducing coating should be applied to the augers, or that the augers should be covered internally with a lower or higher friction fabric.

In an embodiment, the process 700 can determine appropriate dispensation parameters 710 from past dispensation of the same object. For example, the system 700 can log efficiency parameters resulting from a specific angle, coefficient of friction, flighting height, or any other characteristic, and subsequently use those parameters in a future dispensation process. As discussed below, the process 700 can also determine the optimum dispensation parameters dynamically and modify the parameters for each dispensation to achieve maximum efficiency for each individual product while being dispensed.

Optimum flighting 325 properties may also be determined in step 710. For example, the profile, shape, length, taper dimensions, or material for the flighting 325 can be determined without departing from the spirit and scope of the present application.

Following step 710, the determined dispensation parameters can be applied in step 715. Some of the dispensation parameters can be applied automatically by the motherboard 420, for example, the angle of inclination or the speed of rotation of the augers 210, 220. These parameters can be applied automatically by controlling the motors 230 to increase or decrease the rotational speed of the augers 210, 220, or to control another component that modifies the angle of inclination of the augers 210, 220. Any other parameter can be applied automatically, though the motherboard 420 or another component of the product dispensation device 100, where identifying the product to be dispensed in step 705 will result in the parameters being applied to the product dispensation device.

In an embodiment, the optimized parameters can automatically be applied by a single action of the technician, such as, for example, when the product to be dispensed is identified in step 705. In other words, once the technician scans a bar code or other product identification in step 705, for example, the system automatically adjusts all of the necessary parameters to ensure the most efficient and optimized singular product dispensation. In another embodiment, the product identification in step 705 can also change the video displayed on the video monitor. It is a goal of the present application to make the change over from one product to another in the dispensation device 100 as easy and error free for a technician as possible.

Some parameters may need to be applied manually to the product dispensation device. In this scenario, instructions to modify the parameters will be displayed to a technician, e.g., through the display 115. For example, it may not be possible to automatically modify the flighting 325 geometry and, instead, the display 115 can instruct the technician to replace the flighting 325 with an alternate set of flighting better suited for the product identified in step 705.

Once the product is identified in step 705, and the appropriate dispensation parameters are determined 710 and applied 715, the product is dispensed in step 720. In an embodiment, once dispensed, it is determined whether any product remains to be distributed in step 725. Here, the sensors 233*a-e* can determine whether any product remains in any component of the product dispensation device, as discussed above. If no product remains, the process ends.

In an embodiment, if any product remains, the process 700 proceeds to step 730, where the dispensation results are outputted to and stored on the computer-readable recording medium. The process then proceeds to step 710, where the optimum dispensation properties are determined again, taking into account the dispensation results stored in step 730. In this embodiment, the process 700 can dynamically determine the optimum parameters by analyzing actual dispensation efficiency data in a feedback-type mode. For example, the data stored in step 730 may show that the auger 210, 220 rotational speed is too slow, resulting in the auger 210, 220 rotational speed to be increased in step 710.

The products that are dispensed from the product dispensing system can generally include free samples, but the present application is not so limited. For example, the dispensing device 100 can dispense products that require the user to spend money, for example, money that is represented by the customer ID on the card that is scanned by the scanner 120. Further, the products may not be consumer products, but can be any type of substance or product that is capable of being transported within the structure of the product dispensing device 100, for example, toys, gifts, pencils, pens, tools, or any other suitable object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A product dispensation device that dispenses objects, comprising:

a frame;

an auger having first and second open ends and being coupled to the frame and rotatable thereon, the first open end receiving the objects and the second open end dispensing the objects;

an interface that receives an input to cause an identification of the objects;

a computer-readable recording medium storing a computer program executable by a processor and including:

instructions to determine a dispensation parameter based on the identification of at least one physical characteristic of the objects at the interface, application of the dispensation parameter causing the auger to more likely singularly dispense the objects than if the dispensation parameter was not applied;

instructions to automatically apply the dispensation parameter to the auger;

instructions to cause display of information directing a user to perform a manual adjustment to the product dispensation device in addition to the instructions to automatically apply the dispensation parameter, the manual adjustment optimizing a likelihood of the objects being dispensed one at a time; and instructions to cause delivery of the objects after the dispensation parameter is applied and after the user manually adjusts the product dispensation device, wherein the instructions to cause display of information directing a user to manually adjust the product dispensation device includes instructions to display information directing the user to manually adjust at least one parameter selected from the group consisting of a profile, a shape, a length, a taper, a dimension, a friction, and a material of the flighting.

2. The product dispensation device of claim 1, wherein the auger is disposed at an angle relative to the frame.

3. The product dispensation device of claim 2, wherein the dispensation parameter includes the angle.

4. The product dispensation device of claim 2, wherein the dispensation parameter is selected from the group consisting of a rotational speed of the auger, the angle of the auger, and a rotation amount of the auger.

5. The product dispensation device of claim 1, wherein the auger includes fighting extending between the first and second open ends of the auger.

6. The product dispensation device of claim 1, wherein the computer program further includes instructions to output dispensation results indicating an efficiency of dispensing the objects, and analyzing the dispensation results in the instructions to optimize the dispensation parameter.

7. The product dispensation device of claim 1, wherein the dispensation parameter includes a friction of a surface of the auger.

8. The product dispensation device of claim 1, further comprising a plurality of sensors that determine an amount and presence of the objects within the device, wherein the dispensation parameter includes monitoring the sensors.

9. A method of optimizing singular dispensation of products from a product dispensing device that dispenses the products and that includes an auger, the method comprising:

identifying the products with a product identification specific to the products by receiving information at an interface, the product identification identifying at least one physical characteristic of the individual products;

automatically selecting, based on the step of identifying, a product dispensation parameter wherein application of the product dispensation parameter causes the product dispensing device to more likely singularly dispense the objects than if the product dispensation parameter was not applied, wherein the product dispensation parameter includes at least one of an angle of the auger relative to a frame of the device, a rotational speed of the auger, and a rotational amount of the auger;

automatically applying the dispensation parameter to the device;

displaying information directing a user to perform a manual adjustment to the product dispensation device in addition to the step of automatically applying the dispensation parameter, the manual adjustment optimizing a likelihood of the objects being dispensed one at a time; and distributing the products after the dispensation parameter is applied and after the user manually adjusts the product dispensation device, wherein the instructions to cause display of information directing a user to manually adjust the product dispensation device includes instructions to display information directing the user to manually adjust at least one parameter selected from the group consisting of a profile, a shape, a length, a taper, a dimension, a friction, and a material of the flighting.

10. The method as claimed in claim 9, wherein the product dispensation device includes a display that displays a video, and the product dispensation parameter changes the video so that the video relates to the products.

11. The method as claimed in claim 9, wherein the step of automatically selecting the product dispensation parameter is conducted by outputting dispensation results indicating an efficiency of dispensing the products, and analyzing the dispensation results to optimize the dispensation parameter.

* * * * *